US005640766A

United States Patent [19]

Fujino et al.

[11] Patent Number: 5,640,766

[45] Date of Patent: Jun. 24, 1997

[54] METHOD AND APPARATUS FOR PRODUCING A COMPRESSED STRANDED WIRE FOR A PRESS-CONNECTING TERMINAL

[75] Inventors: Toshihiro Fujino; Tamotsu Nishijima, both of Shizuoka, Japan

[73] Assignee: Yazaki Corporation, Tokyo, Japan

[21] Appl. No.: 442,407

[22] Filed: May 16, 1995

Related U.S. Application Data

[62] Division of Ser. No. 201,337, Feb. 24, 1994, Pat. No. 5,449,861.

[30] Foreign Application Priority Data

Feb. 24, 1993 [JP] Japan ..... 5-35659
Feb. 24, 1993 [JP] Japan ..... 5-35660

[51] Int. Cl.[6] ..... H01R 43/28; H01B 13/06

[52] U.S. Cl. ..... 29/872; 29/33 F; 29/828; 57/9; 57/12; 57/15

[58] Field of Search ..... 29/825, 828, 872, 29/33 F, 745; 57/9, 12, 15, 213–215, 293; 174/113 A, 128.1, 130

[56] References Cited

U.S. PATENT DOCUMENTS

| | | | |
|---|---|---|---|
| 1,943,087 | 1/1934 | Potter et al. | 174/128.1 X |
| 3,234,722 | 2/1966 | Gilmore | 174/128.1 X |
| 3,352,098 | 11/1967 | Gilmore | 57/214 |
| 3,444,684 | 5/1969 | Schoerner et al. | 57/15 X |
| 3,641,755 | 2/1972 | Heinen et al. | 57/9 |
| 4,311,001 | 1/1982 | Glushko et al. | 57/215 |
| 4,429,519 | 2/1984 | Garner et al. | 57/293 |
| 4,471,161 | 9/1984 | Drummond | 174/130 X |
| 4,473,995 | 10/1984 | Gentry | 57/9 |
| 4,530,205 | 7/1985 | Seiler et al. | 57/9 |
| 4,648,673 | 3/1987 | Endo et al. | 439/397 |
| 4,687,884 | 8/1987 | DeHart | 174/130 |
| 5,133,121 | 7/1992 | Birbeck et al. | 29/872 |
| 5,260,516 | 11/1993 | Blackmore | 174/113 A |

FOREIGN PATENT DOCUMENTS

| | | |
|---|---|---|
| 1-95420 | 4/1989 | Japan . |
| 1-302615 | 12/1989 | Japan . |
| 4-12593 | 3/1992 | Japan . |

*Primary Examiner*—Peter Vo

*Attorney, Agent, or Firm*—Sughrue, Mion, Zinn, Macpeak & Seas

[57] ABSTRACT

The present invention provides a wire for a press-connecting terminal which has a high flexibility, and achieves a high reliability for a connection portion at the time of press-connection, and also provides a method of producing a conductor of such a wire. The wire provides a stranded conductor and an insulator covering the conductor. Wire elements of the stranded conductor are concentrically twisted in layers in the same direction at the same pitch, and the stranded conductor is compressed into a circular cross-section in such a manner that a space factor of the cross-section of the conductor is not less than 99%. The present invention also provides a multi-layer compressed concentric stranded conductor which enables a uniform compression of a base stranded wire. Not more than 61 wire elements of the same diameter are twisted together in such a manner that the number of the wire elements of a Nth layer except for the central wire element is 6N and that a line, interconnecting the centers of the wire elements of each of those layers including a second layer and any other layer outside of the second layer counting from the central wire element, has a dodecagonal shape, and subsequently the thus twisted wire elements are compressed into a circular cross-sectional shape.

3 Claims, 15 Drawing Sheets

METHOD AND APPARATUS FOR PRODUCING A COMPRESSED STRANDED WIRE FOR A PRESS-CONNECTING TERMINAL

This is a divisional of application No. 08/201,337, filed Feb. 24, 1994, now U.S. Pat. No. 5,449,861.

BACKGROUND OF THE INVENTION

The present invention relates to a wire for use in a so-called wire harness provided within an electrical equipment and an ordinary transport machine, and more particularly to a wire for a low-pressure press-connecting terminal which wire can be suitably press-connected to a connection portion of the metal terminal.

Further, the present invention relates to a compressed stranded conductor used as a wire, and more particularly to a multi-layer compressed concentric twisted (stranded) conductor having a space factor of not less than 99%, and also to a method of producing the same.

Generally, in an electrical equipment and a transport machine such as an automobile, a wire bundle, commonly referred to as a wire harness consisting of a predetermined number of wires pre-assembled together into a required length in accordance with the arrangement of electrical component parts within the electrical equipment or the machine, is used for the convenience of assembling of such device. In such a harness wire and particularly one of a low-pressure design, a press-connection, by which the connection is completed without the need for peeling an insulative covering material, is often carried out. In this press-connection as shown in FIG. 13, a harness wire w is forced into a slot $t_1$ of a press-connecting terminal t, so that a covering material $w_1$ is torn by an edge of the slot $t_1$, thereby making electrical connection between a conductor $w_2$ in the wire and the edge of the slot $t_1$ (See Examined Japanese Patent Publication No. 4-12593).

FIGS. 14, 15 and 16 show conductors of a wire heretofore used within an electrical equipment and a transport machine such as an automobile.

The assembled-type twisted wire $A_6$ of FIG. 14 is formed by twisting a number of constituent elements a together, and the position of the constituent wire elements a with respect to one another is not constant, and is unstable. For example, when examining this positional relation in the direction of its length, those element wires, disposed near to the center of the wire in the beginning, is often located at an outer layer at another portion of the twisted wire.

FIG. 15 shows a most common 7-core twisted wire $A_7$ having 6 wire elements a twisted around a central element a.

FIG. 16 shows a multi-layer concentric twisted wire $A_8$ in which a first layer $L_1$ of 6 wire elements a are twisted around a central wire element a, and a second layer $L_2$ of wire elements a and a third layer $L_3$ of wire elements a are sequentially twisted around the first layer. In this case, the directions of twisting of the constituent wire elements of the first layer $L_1$, the second layer $L_2$, the third layer $L_3$ . . . are alternately opposite, and these layers are different in twisting pitch from one another.

Such a multi-layer alternately twisted wire for use as an electric wire is subjected to compression for the purpose of enhancing the ability of press-connection to a connector, reducing the electric wire into a small diameter, saving the amount of the insulative material, enhancing a stress corrosion cracking resistance, and enhancing electrical characteristics, and various methods for this purpose have been proposed.

The condition of press-connection of such a conventional wire is shown in FIG. 17. When a harness wire w' is further forced into a slot $t_1'$ of a press-connecting terminal t', with its insulative material $w_1'$ cut by an edge $t_2'$ of this slot (see FIG. 17(A)), a stranded conductor $w_2'$ twisted into a substantially circular cross-sectional shape gets out of shape (see FIG. 17(B)). Therefore, electrical connection between the stranded conductor $w_2'$ and the edge $t_2'$ becomes unstable.

In order to overcome such an unstable electrical connection, recently, strands have been integrally joined together collectively by plating, or a compressed conductor or the like as shown in FIG. 18 has been used, thereby enhancing the reliability in press-connection. FIG. 18 shows the compressed conductor $A_9'$ compressed at a rate of about 93%. Here, the compression ratio means a space factor, and means the ratio of the actual cross-sectional area of the stranded conductor to the area of a circle circumscribing the cross-section of the stranded conductor. These constructions are both directed mainly to the ability of maintaining the shape, and sacrifice an expected flexibility of the stranded wire accordingly. Furthermore, since spaces s are formed between the constituent wire elements a', the small-diameter design has not yet been sufficiently achieved.

Referring to wires at large, examples of multi-layer wire subjected to compression are shown in FIGS. 19 and 20.

FIG. 19 shows the condition of compression of constituent wire elements a' of a stranded conductor $A_{10}'$ compressed at a time as in the multi-layer wire (FIG. 16) having the layers twisted alternately in opposite directions. The directions of twisting of the layers are alternately opposite, and the constituent wire elements a' necessarily intersect the wire elements of the upper and lower adjacent layers, and therefore the degree of compression is naturally limited.

FIG. 20 shows a compressed conductor $A_{11}'$ in which compression for shaping purposes is effected for each layer. However, this type is limited to the use as a high-voltage wire, and besides the purpose of compression is to enhance electrical characteristics rather than to achieve a small-diameter design. Furthermore, the direction of twisting of constituent wire elements a of the layer $L_1'$ is opposite to the direction of twisting of constituent wire elements a of the adjacent layer $L_2'$, and the layers are different in pitch from each other.

With respect to methods of producing these conventional wires, there have heretofore been used various kinds of twisting machines for producing a wire having a relatively small space factor (which means that the wire is not subjected to a high degree of compression), and the wire can be produced, using any of these machines. In this case, they are classified into the type in which pre-shaped constituent wire elements in the form of profiles are twisted together and the type in which wire elements are twisted together, and then are passed through a die or the like to be compressed.

In the production of a wire with a relative large space factor in which wire elements are compressed at each layer into a circular cross-sectional shape (see FIG. 20), a first layer $L_i'$ of wire elements are compressed around a central wire element a while being twisted, and further a second layer $L_2'$ of wire elements are compressed around the thus shaped twisted wires $L_1'$ while being twisted. Therefore, in order to produce the compressed conductor $A_{11}'$ of this construction, there are required machines for applying compression which are equal in number to the layers of twisted wires. Therefore, the apparatus inevitably has a large overall size, and is complicated.

Another method of producing a twisted wire having a higher space factor employs a wire twisting and drawing machine disclosed, for example, in Unexamined Japanese Patent Publication No. 1-95420. With this method, however, in so far as a wire of an ordinary construction is used as a base wire, only the twisted wires of up to the first layer can be compressed at a high degree.

Thus, in the wires for a press-connecting terminal in an electrical equipment and a transport machine, various attempts have been made, directing attention to the ability of maintaining the cross-sectional shape of the conductor in order to enhance the reliability of the press-connection; however, because of such an improved ability of maintaining the cross-sectional shape, the flexibility has been sacrificed, and as a result there have been encountered problems such as (1) a lowered operation efficiency in connection with the wiring and (2) a degraded fatigue resistance to vibrations during use. Furthermore, because of a demand for a small-size design of various devices, (3) the wire for a harness has been required to have a small diameter.

Therefore, it can be said that requirements for the wire for a press-connecting terminal within an electrical equipment and an ordinary transport machine are (A) to have a sufficient flexibility, (B) to have a sufficient ability to maintain the cross-sectional shape, and (C) to have a sufficiently small diameter. However, there has been no prior art construction which meets all of these requirements.

For example, in the twisted wire subjected to collective plating, the cost is clearly increased by the plating step. The assembled-type twisted wire, as well as the concentric twisted wire providing round wire elements, does not have the ability of maintaining the cross-sectional shape, and also can not have a small-diameter design. In the 7-core compressed stranded conductor, the flexibility, the ability of maintaining the cross-sectional shape and the small-diameter design have been achieved to a considerable level, but have not yet been sufficient.

Referring to power wires or cables at large, some of them have such a configuration that they can be compressed, but even if they are reduced in size so as to be used as a wire for a press-connecting terminal of an electrical equipment and a transport machine, sufficient compression can not be expected, or a production method inevitably becomes complicated, and is large in size, which increases the cost.

SUMMARY OF THE INVENTION

An object of the present invention is to provide a wire for a press-connecting terminal of an electrical equipment and a transport machine which meets with the above various requirements.

In order to solve the conventional problems, the inventors of the present invention have found that the wire for a press-connecting terminal of an electrical equipment and a transport machine: (1) should have a multi-layer twisted construction for achieving the flexibility of the wire; (2) should be sufficiently compressed for achieving a small-diameter design; and (3) should have such a construction that constituent wire elements are held in sufficiently intimate contact with one another against movement for achieving a reliability in press-connection. Further, in order to achieve these (1) to (3) requirements at the same time, the inventors of the present invention have found that; (4) a completely dense construction should be provided, which can not be obtained if the directions of twisting of the layers are different; and (5) the concentric twisting at the same pitch must be provided.

In order to achieve the above object, the present invention provides a wire for a press-connecting terminal of an electrical equipment and a transport machine, providing a stranded conductor, and an insulator covering the conductor, characterized in that constituent wire elements of the stranded conductor are concentrically twisted in layers in the same direction at the same pitch; and that the stranded conductor is compressed into a circular cross-section in such a manner that a space factor of the cross-section of the stranded conductor is not less than 99%.

Further, the present invention also provides a method of producing a conductor of a wire for a press-connecting terminal of an electrical equipment and a transport machine, which is characterized in that a multi-layer base stranded wire, having constituent wire elements concentrically twisted in the same direction at the same pitch, is supplied to a wire twisting and drawing device which provides a diameter-reducing mechanism for reducing the diameter of the base stranded wire by passing the base stranded wire through an orifice smaller in cross-sectional area than the base stranded wire, and a twisting mechanism for imparting twisting to the base stranded wire.

The wire for a press-connecting terminal have the constituent wire elements held in intimate contact with one another, and can be bent with a small bending force.

Another object of the present invention is to provide a multi-layer compressed concentric stranded conductor which uses wire elements of the same diameter, and will not become unstable during a compression processing, and also to provide a method of producing such a conductor.

In order to achieve the above object, the present invention provides a multi-layer compressed concentric stranded conductor characterized in that the number of wire elements of an Nth layer except for a central wire element is 6N; the number of all the wire elements is limited to up to 61; the wire elements are concentrically twisted in layers in the same direction at the same pitch; the stranded conductor is compressed into a circular cross-section in such a manner that a space factor of the cross-section of the stranded conductor is not less than 99%; and that all of the wire elements, except for the central wire element and the wire elements of an outermost layer, have a pentagonal cross-sectional shape.

Further, in order to achieve the above object, the present invention also provides a method of producing a multi-layer compressed concentric stranded conductor characterized in that not more than 61 wire elements of the same diameter are twisted together in such a manner that the number of the wire elements of a Nth layer except for the central wire element is 6N and that a line, interconnecting the centers of the wire elements of each of those layers including a second layer and any other layer outside of the second layer counting from the central wire element, has a dodecagonal shape; and subsequently the thus twisted wire elements are compressed into a circular cross-sectional shape.

During the compression processing, every other wire element of the dodecagonal outermost layer of the base stranded wire is initially brought into contact with a contacting circle of a die, and finally all of the wire elements of the outermost layer are brought into contact with the contacting circle of the die.

BRIEF DESCRIPTION OF THE DRAWINGS

FIG. 18 is a cross-sectional view of a 7-core compressed conductor;

DESCRIPTION OF THE PREFERRED EMBODIMENTS

Figure 1:
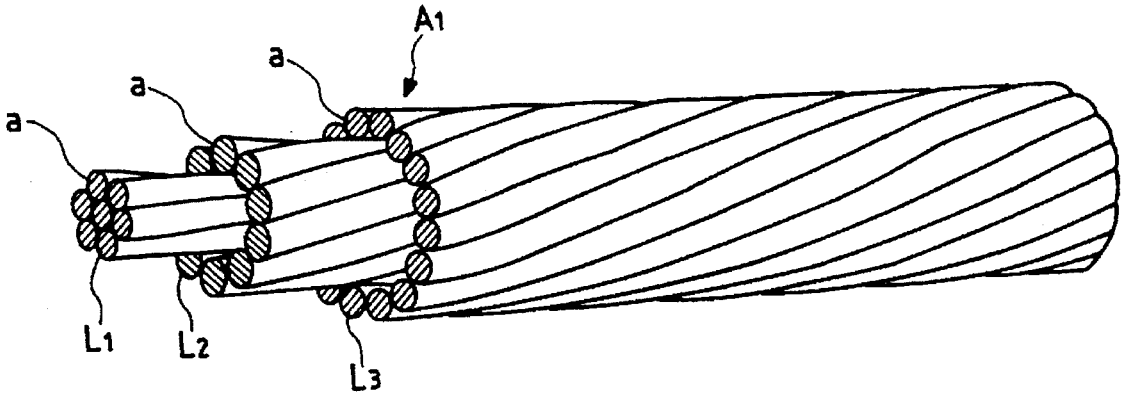
FIG. 1 is a perspective view of one example of a base stranded wire of the present invention.
Figure 2:
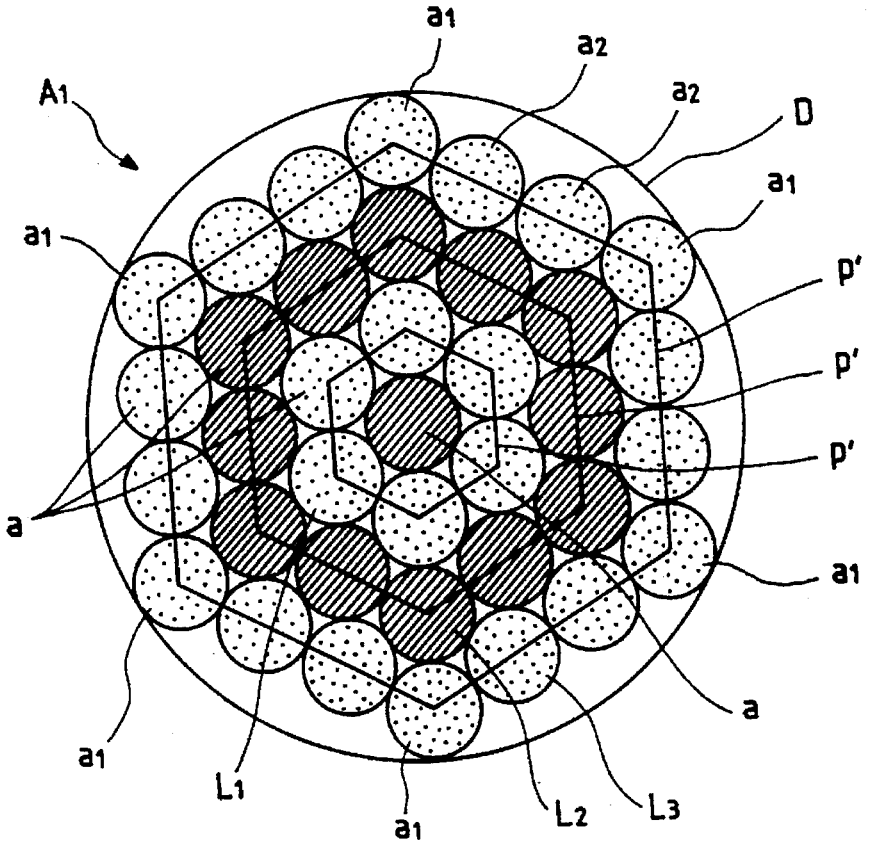
FIG. 2 is a cross-sectional view of the base stranded wire.
Figure 3:
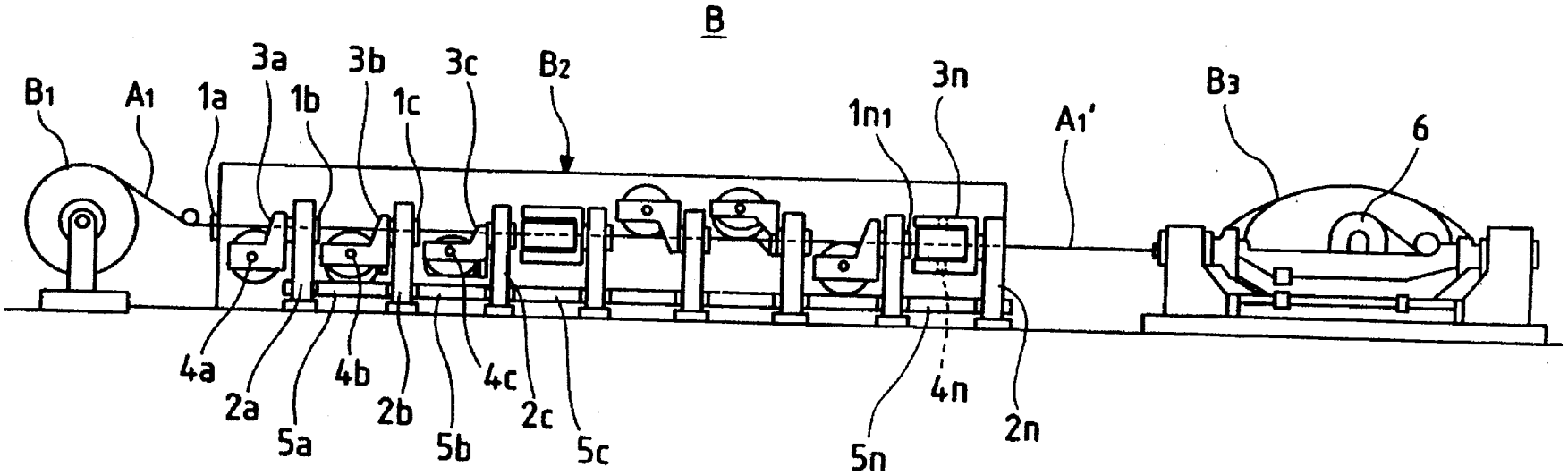
FIG. 3 is a view showing an overall construction of an apparatus used for performing a production method of the present invention.

In the present invention, a base stranded wire $A_1$, having layers $L_1$, $L_2$ and $L_3$ of wire elements a of the same diameter twisted concentrically in the same direction at the same pitch as shown in FIGS. 1 and 2, is compressed by a twisted wire producing apparatus B shown in FIG. 3, thereby producing a wire $A_1$" (FIG. 4) for a press-connecting terminal which wire has a multi-layer compressed concentric stranded conductor $A_1$'.

In the base stranded wire $A_1$, a total of 37 wire elements a, that is, the central wire element a, the first layer $L_1$ of 6 wire elements, the second layer $L_2$ of 12 wire elements and the third layer $L_3$ of 18 wire elements, are arranged concentrically except for the central wire element a, and these wire elements are arranged most densely in such a manner that the second and third layers $L_2$ and $L_3$ have a hexagonal shape as indicated by a connection line p' interconnecting the wire elements a of each of the second and third layers $L_2$ and $L_3$, and these wire elements are twisted in the same direction at the same pitch.

In FIG. 3, the twisted wire producing apparatus B provides a base stranded wire supply device $B_1$, a wire twisting and drawing device $B_2$, and a rotary-type take-up device $B_3$. The base stranded wire supply device $B_1$ provides a supply stand, and supplies the base stranded wire $A_1$ at a predetermined speed.

The wire twisting and drawing device $B_2$ has a wire drawing die 1*a* provided at an inlet thereof. Provided rearwardly of the wire drawing die 1*a* is a support post 2*a* fixedly mounted on a floor of the wire twisting and drawing device $B_2$. An arm 3*a* is pivotally mounted on the support post 2*a* in a cantilever manner. A capstan 4*a* is rotatably mounted on the arm 3*a*. A wire drawing die 1*b* for drawing the twisted wire during the drawing operation is mounted on a rear surface of the support post 2*a*. Although not shown, a drive mechanism is provided within the arm 3*a*, and the arm 3*a* can be pivotally moved by this drive mechanism. Therefore, when the arm 3*a* is pivotally moved, the capstan 4*a* is rotated about a support shaft of the arm 3*a*. Capstans 4*c* . . . 4*n* are mounted rearwardly of the capstan 4*a* in the same manner as that of a capstan 4*b*.

The capstans 4*a*, 4*b*, 4*c* . . . 4*n* are different in speed of revolution (angular movement) from one another. This arrangement is provided in order that the wire can be twisted in the optimum condition in such a manner that the wire can be twisted uniformly without causing uneven twisting which is attributable to the fact that elongation of the twisting pitch due to the drawing of the twisted wire varies depending on the position of drawing orifices. Those portions of the twisted wire passed respectively through the drawing dies 1*a*, 1*b*, 1*c* 1*n* are supported by the capstans 4*a*, 4*b*, 4*c* . . . 4*n*, respectively, and a propelling force is imparted by these capstans 4*a*, 4*b*, 4*c* . . . 4*n*. A rotation shaft 5*a*, 5*b*, 5*c* . . . 5*n* is provided between any two adjacent ones of the support posts 2*a*, 2*b*, 2*c* . . . 2*n*. Each of the rotation shafts 5*a*, 5*b*, 5*c* . . . 5*n* transmits a rotational force of speed, determined in accordance with the drawing so as to obtain a predetermined twisting pitch, to a respective one of drive mechanisms contained respectively in the support posts 2*a*, 2*b*, 2*c* . . . 2*n*. Therefore, the rotation shafts 5*a*, 5*b*, 5*c* . . . 5*n* are rotated by a drive device (not shown), and the arms 3*a*, 3*b*, 3*c* . . . 3*n* are pivotally moved by the rotation shafts 5*a*, 5*b*, 5*c* . . . 5*n*, respectively, thereby angularly moving the capstans 4*a*, 4*b*, 4*c* . . . 4*n*.

In the wire twisting and drawing device $B_2$, the base stranded wire $A_1$ supplied from the base stranded wire supply device $B_1$ is twisted by the capstans 4*a*, 4*b*, 4*c* . . . 4*n* while being drawn by the drawing dies 1*a*, 1*b*, 1*c* . . . 1*n*. Namely, twisting is imparted to the base stranded wire $A_1$ while drawing it.

The compressed twisted wire $A_1$', drawn into a desired small diameter by the wire twisting and drawing device $B_2$, is twisted at a predetermined twisting pitch, and is wound on a winding drum 6 by the rotary-type take-up device $B_3$.

In order that any unevenly-twisted portion will not develop even if the twisting pitch is elongated by reducing the area to a greater degree, the drawing dies 1*b*, 1*c* . . . 1*n* except for the first drawing die 1*a* can be rotated.

This operation will now be described. The multi-layer concentric base stranded wire $A_1$ (see FIG. 1), having the layers twisted in the same direction at the same pitch, is fed from the base stranded wire supply device $B_1$. Then, this wire first passes through the drawing die 1*a* of the wire twisting and drawing device $B_2$, and is supported by the capstan 4*a*, and then passes through the drawing die 1*b* and then sequentially passes past the capstan 4*b*, the drawing die 1*c* . . . , so that the wire is formed into the compressed twisted wire $A_1'$ of a desired diameter, and is fed to the rotary-type take-up device $B_3$. In the wire twisting and drawing device $B_2$, the propelling force is imparted to the twisted wire by the capstans 4*a*, 4*b*, 4*c* . . . 4*n*. The capstans 4*a*, 4*b*, 4*c* . . . 4*n* angularly move during the passage of the twisted wire, and therefore twisting is imparted in a direction to make the twisting pitch tight during the drawing. Thus, elongation of the twisting pitch is absorbed to such an extent as not to cause so-called "laugh" before the twisted wire passes through the subsequent drawing die. Thus, the initially-supplied multi-layer concentric base stranded wire $A_1$, having the layers twisted in the same direction at the same pitch, is gradually compressed and processed into a space factor of not less than 99%, thereby producing the electrical conductor $A_1'$ for a press-connecting terminal of an electrical equipment and a transport machine.

Figure 4:
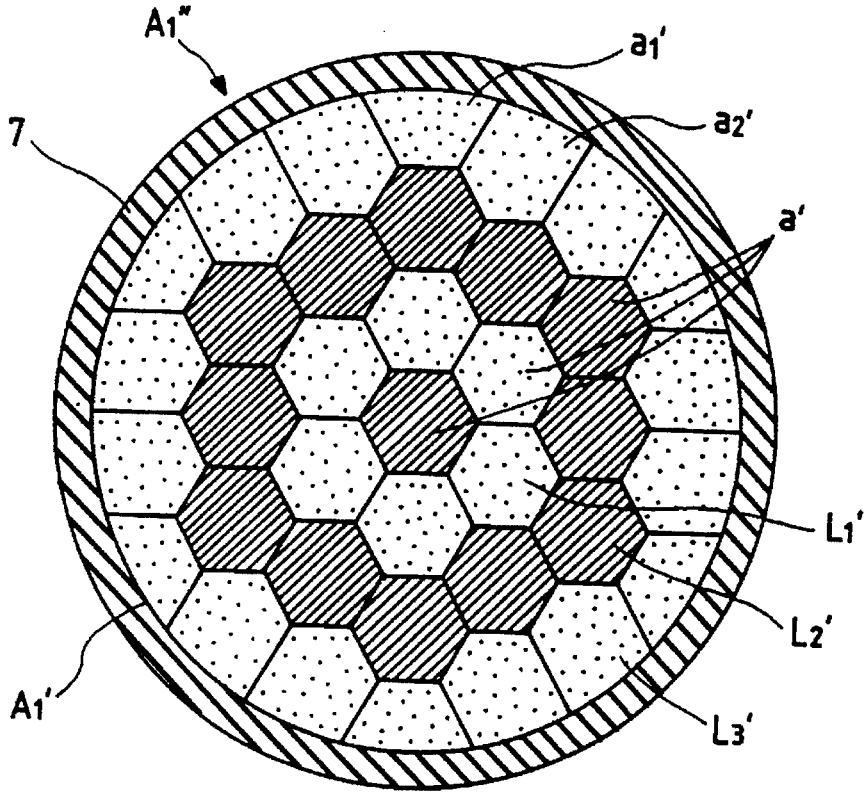
FIG. 4 is a cross-sectional view of a wire for a press-connecting terminal which is produced by compressing the base stranded wire of FIGS. 1 and 2.

In FIG. 4, the wire $A_1''$ for a press-connecting terminal of an electrical equipment and a transport machine, provided in accordance with the present invention, provides the electrical conductor $A_1'$ and an insulator 7. The electrical conductor $A_1'$ provides the 37-core multi-layer twisted wire. The central wire element and the combined wire elements of each of the first and second layers $L_1'$ and $L_2'$ have a substantially hexagonal cross-sectional shape a', and the third or outermost layer $L_3$ consists of the wire elements $a_1'$ of a substantially square cross-section and the wire element $a_2'$ of a substantially pentagonal cross-section which are combined together.

Figure 5:
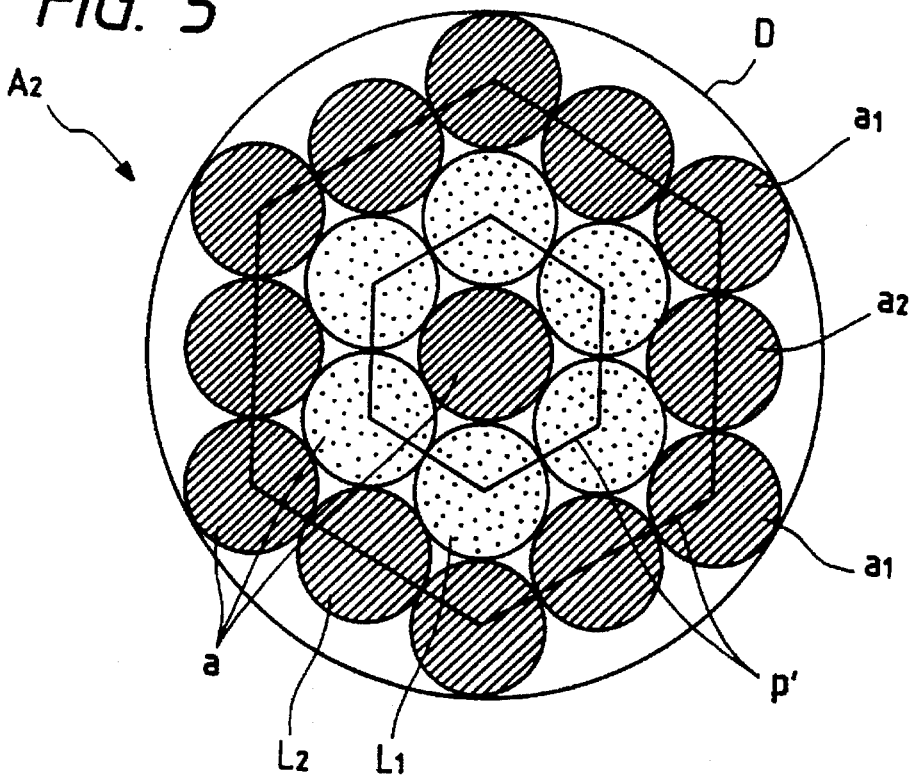
FIG. 5 is a cross-sectional view of another example of base stranded wire of the present invention.
Figure 6:
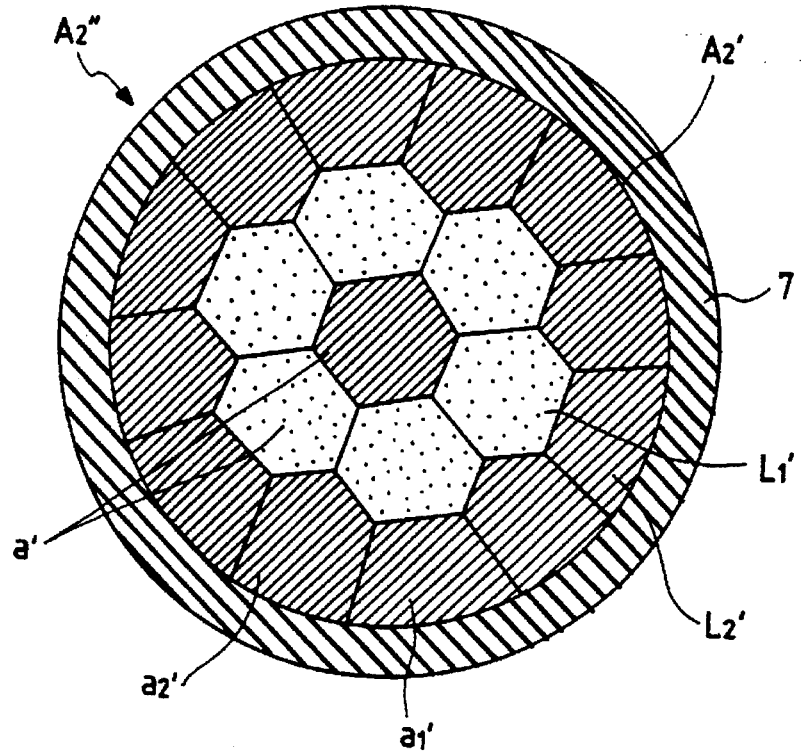
FIG. 6 is a cross-sectional view of a wire for a press-connecting terminal which is produced by compressing the base stranded wire of FIG. 5.

In a base stranded wire $A_2$ shown in FIG. 5, a total of 19 wire elements a, that is, a central wire element a, a first layer $L_1$ of 6 wire elements and a second layer $L_2$ of 12 wire elements, are arranged concentrically except for the central wire element, and the wire elements are arranged most densely in such a manner that the second layer $L_2$ has a hexagonal shape as indicated by a connection line p' interconnecting the wire elements a of the second layer $L_2$, and these wire elements are twisted in the same direction at the same pitch. This base stranded wire is supplied to the twisted wire producing apparatus B of FIG. 3 in the same manner as described above. As a result, there is formed an electrical conductor $A_2'$ in which the central wire element and the combined wire elements of the first layer $L_1'$ has a substantially hexagonal cross-sectional shape a', and the second or outermost layer $L_2'$ consists of the wire elements $a_1'$ of a substantially square cross-section and the wire element $a_2'$ of a substantially pentagonal cross-section which are combined together in an alternate manner. An insulative covering member 7 is formed on this electrical conductor to provide a wire $A_2''$ for a press-connecting terminal of an electrical equipment and a transport machine (FIG. 6).

As can be appreciated from the drawings, with respect to features of the wires of the above embodiment for a press-connecting terminal of an electrical equipment and a transport machine, the conductor is cross-sectionally circularly compressed into a space factor of not less than 99%, and the number of constituent wire elements of the Nth layer except for the central wire element is 6×N. Therefore, the constituent wire elements of all the layers except for the outermost layer have a substantially hexagonal cross-section, and the constituent wire elements are combined together densely. And besides, because of the necessity arising from the production method, that is, the method in which all of the constituent wire elements are turned at the same speed in the same direction, the constituent wire elements are twisted in the same direction at the same pitch.

Figure 14:
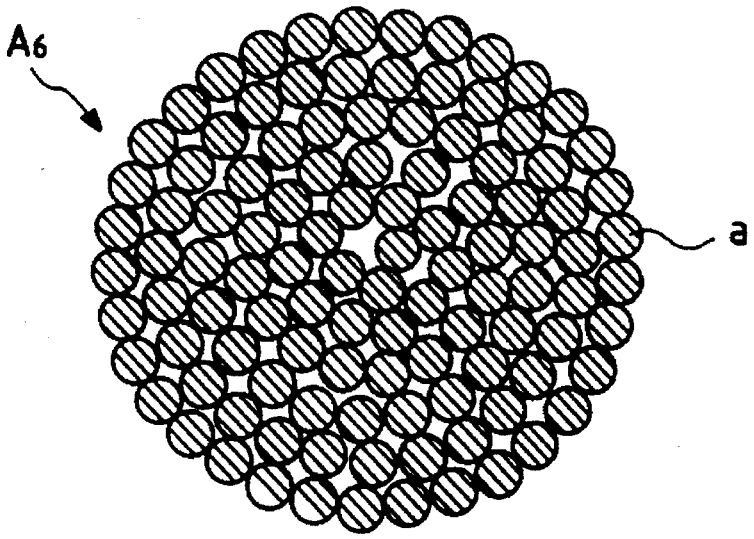
FIG. 14 PRIOR ART
FIG. 14 is a cross-sectional view of an assembled-type twisted wire.
Figure 15:
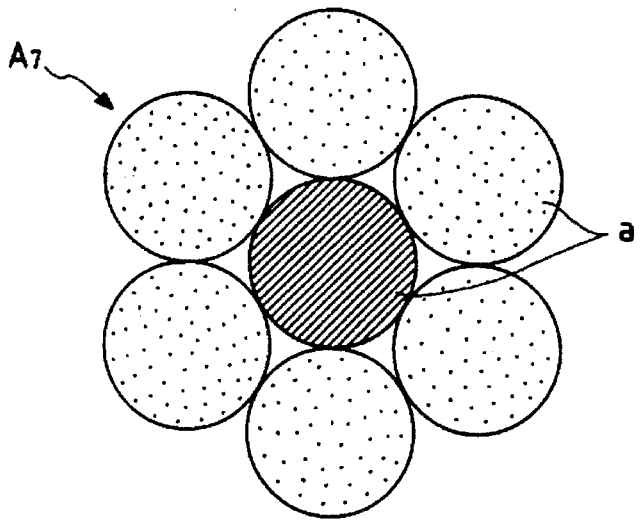
FIG. 15 PRIOR ART
FIG. 15 is a cross-sectional view of a non-compressed stranded conductor.
Figure 18:
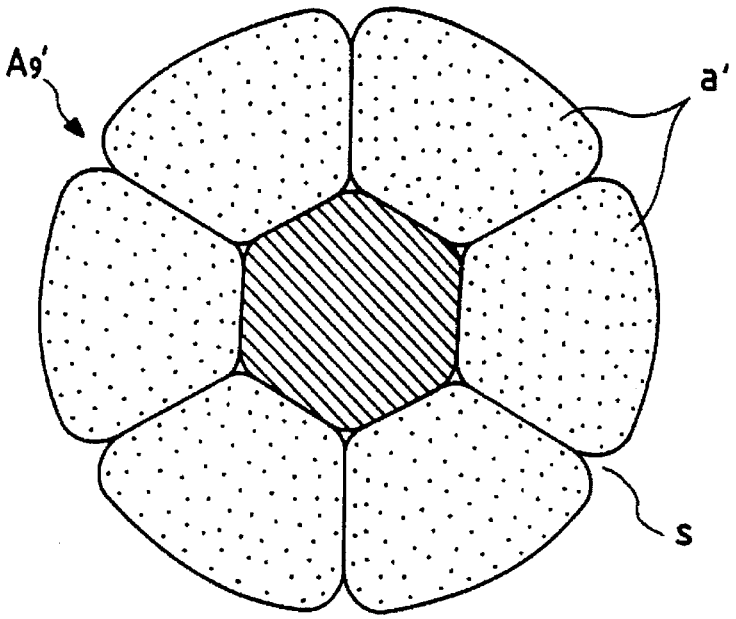
FIG. 18 PRIOR ART
FIG. 18 is a cross-sectional view of a 37-core multi-layer concentric stranded conductor produced by compressing the twisted wire of FIG. 7.
Figure 19:
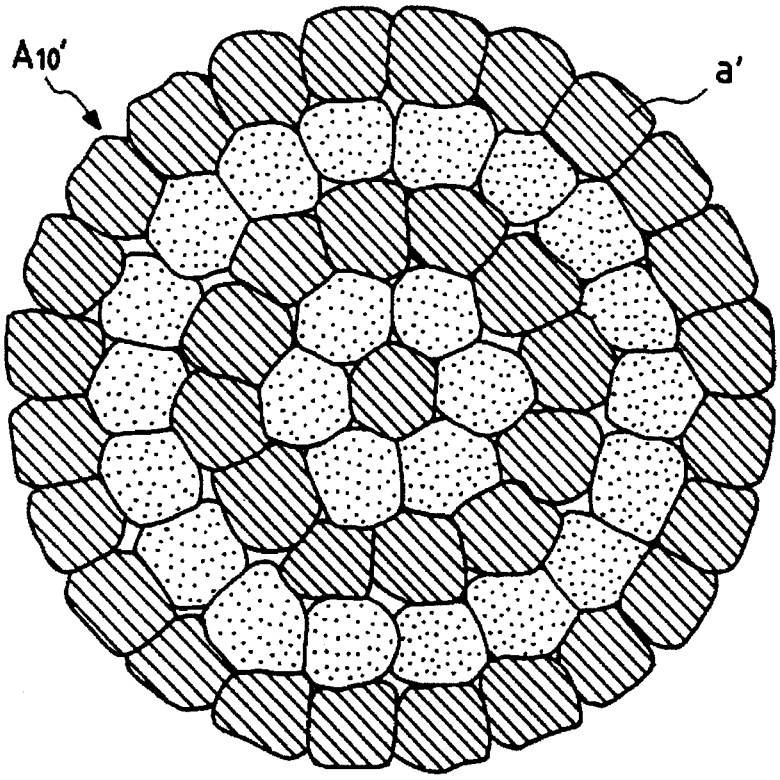
FIG. 19 PRIOR ART
FIG. 19 is a cross-sectional view of a compressed twisted wire.

The thus produced compressed conductors of the above embodiment are the multi-layer multi-core twisted wire, and therefore have a higher flexibility than the 7-core wires shown in FIGS. 15 and 18. Furthermore, the conductors of the above embodiment have a far higher space factor as compared with the assembled-type multi-core twisted wire of FIG. 14 and the alternately-twisted multi-layer compressed wire of FIG. 19, and therefore can be of a small-diameter design.

Figure 20:
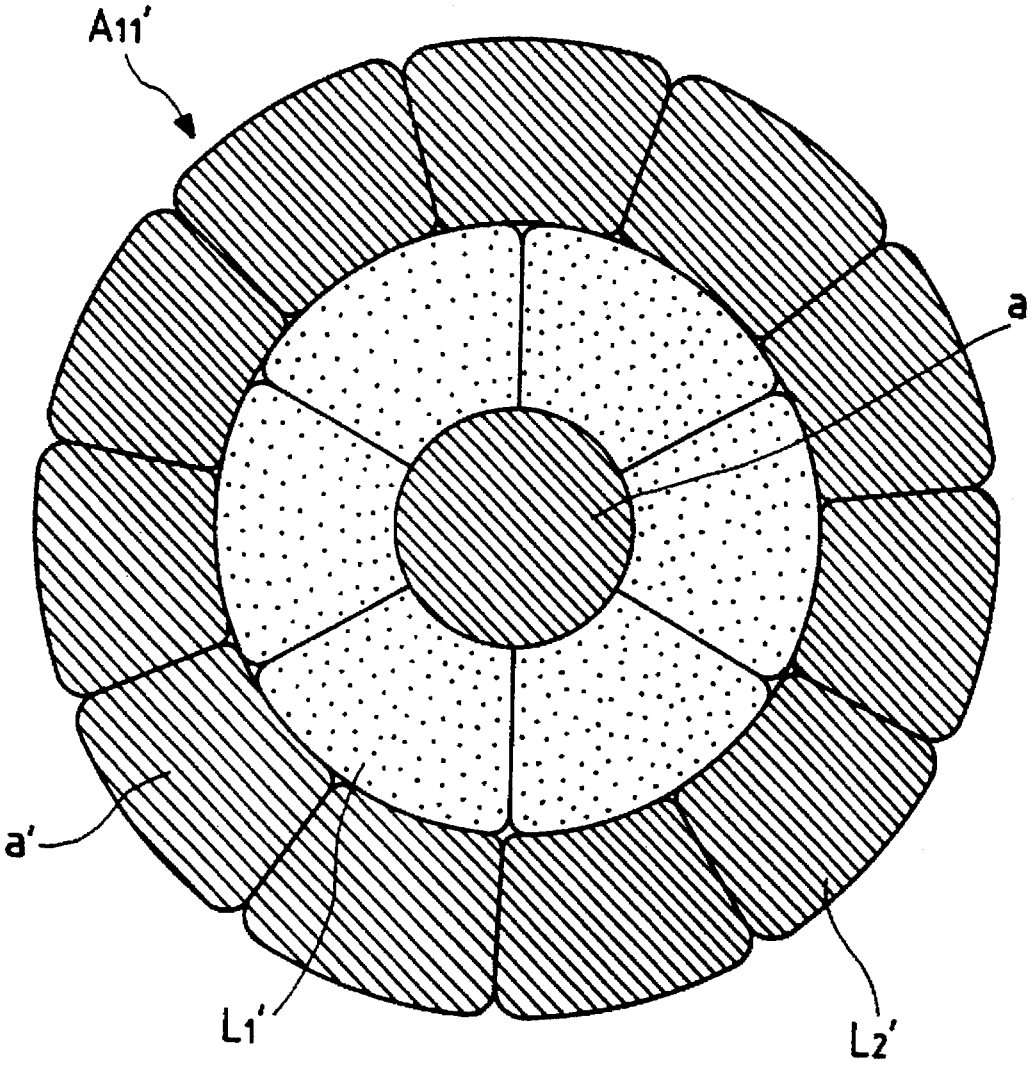
FIG. 20 PRIOR ART
FIG. 20 is a cross-sectional view of a twisted wire in which each layer is compressed.
Figure 21A:
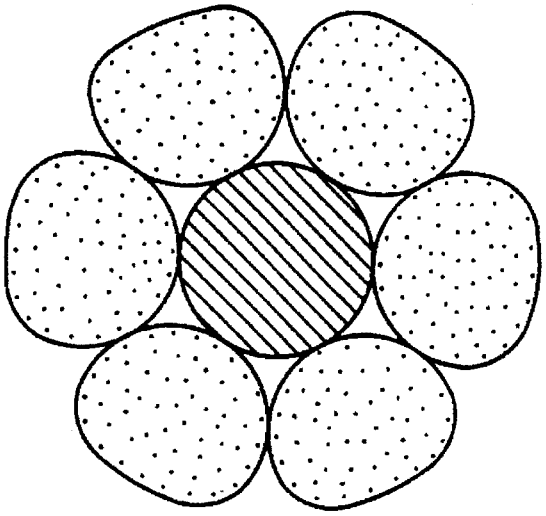
FIGS. 21(A), 21(B), 21(C) and 21(D) are views showing a change of a cross-section of a twisted wire during compression thereof.
Figure 21B:
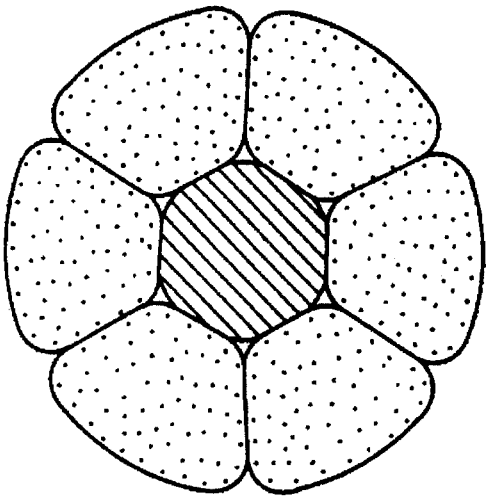
Figure 21C:
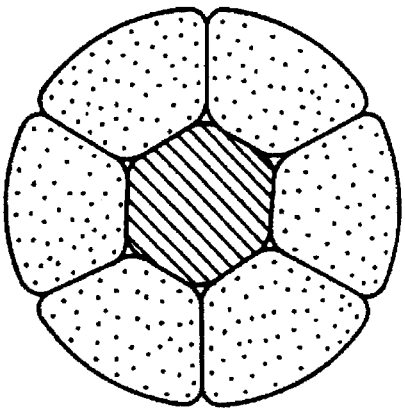
Figure 21D:
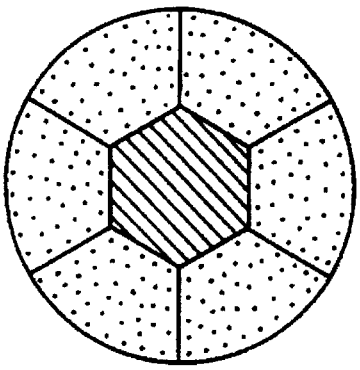

Moreover, as compared with the twisted wire of FIG. 20 in which the layers are twisted alternately in opposite directions, and the compression is effected for each layer the constituent wire elements of the conductor of the above embodiment have a larger number of surfaces (6 surfaces in the embodiment; 4 surfaces in the conventional example) held in contact with the adjacent constituent wire elements, and therefore the effect of retaining the constituent wire elements against movement relative to one another is obtained to thereby provide an enhanced bridge effect, thus enhancing the ability of maintaining the cross-sectional shape.

In order to determine a reasonable limit of the space factor, samples of a 7-core concentric twisted compressed conductor (pure copper) having a nominal diameter of 14 $mm^2$ were compressed, and the outer diameter and space factor of these samples are shown in Table 1. Here, the space factor is expressed in terms of the ratio of the actual cross-sectional area, calculated from the weight, to the cross-sectional area of a circumscribing circle calculated from the outer diameter.

TABLE 1

(Outer Diameter and Space Factor of Samples)

| No. | Outer diameter (ø) | Space Factor (%) | Note |
|---|---|---|---|
| 1 | 4.43 | 88.8 | 14 $mm^2$ base wire |
| 2 | 3.88 | 93.4 | |
| 3 | 3.51 | 96.1 | |
| 4 | 2.79 | 99.8 | |

The cross-sectional shape of these samples was changed as shown in FIG. 21. FIGS. 21(A), 21(B), 21(C) and 21(D) show microphotographs of the cross-section of the sample at sequential compression stages, subjected to a picture processing.

Although the multi-core twisted wire of FIG. 21 does not correspond to the twisted wires of the above embodiment of the present invention, it will be appreciated that in various kinds of twisted wires, a substantially completely circular cross-section is obtained at least with the space factor of not less than 99%.

In the above embodiment (FIGS. 1–6), the wire elements are equal in cross-sectional area, and the number of the constituent wire elements of each layer except for the central wire element is a multiple of 6 in order to obtain the dense cross-sectional structure; however, by changing the diameter of the wire elements, the number of the wire elements can be changed, and such a construction can be produced by the production method of the present invention. In this embodiment, although the compressed wire elements have substantially square, pentagonal and hexagonal shapes, the present invention is not limited to such shapes.

Furthermore, in this embodiment, although the central wire element is provided, a multi-layer concentric twisted wire with no central wire element also falls within the scope of the present invention, and can be produced by the production method of the present invention.

The above electrical stranded conductors of the wires of the present invention for a press-connecting terminal of an electrical equipment and a transport machine are the multi-layer twisted wire although they are compressed, and therefore the wire can be bent with a small bending force. Namely, a high flexibility is obtained, and therefore the ability of installing the wire can be enhanced. Further, the fatigue resistance is excellent, and the rupture strength against repeated bending is enhanced.

The stranded conductor is compressed into a circular cross-section in such a manner that the space factor of the cross-sectional area of the stranded conductor is not less than 99%, and as a result, apparently, the conductor has a substantially completely circular cross-section, and therefore there is obtained the conductor having substantially the same outer diameter and cross-sectional area as those of a single wire. Therefore, a small-diameter design can be achieved.

As a result of cross-sectionally circularly compressing the conductor into a space factor of not less than 99%, the constituent wire elements are combined together in intimate contact with one another, and therefore the circular condition of the cross-section can hardly be out of shape, thereby enhancing the reliability of the press-connecting portion.

Furthermore, the multi-layer twisted wire with or without the central wire element, having the constituent wire elements twisted concentrically in the same direction at the same pitch, is supplied to the wire twisting and drawing device which provides the diameter-reducing mechanism in which the base stranded wire is passed through the orifices smaller in cross-sectional area than the base stranded wire, thereby reducing the diameter of the base stranded wire, and the twisting mechanism for imparting twisting to the base stranded wire. By doing so, the stranded conductor of the wire for a press-connecting terminal of an electrical equipment and a transport machine can be produced.

When the multi-layer alternately twisted wire $A_1$ (FIG. 2) of the above construction (the first embodiment) is compressed, only those wire elements $a_1$ of the third layer disposed at apexes of the regular hexagonal arrangement are contacted with a contacting circle D of the die hole, and the two wire elements $a_2$ disposed between any two adjacent apexes are not in contact with the die hole. Therefore, this construction has a disadvantage that it is inferior in uniform compression.

Figure 22:
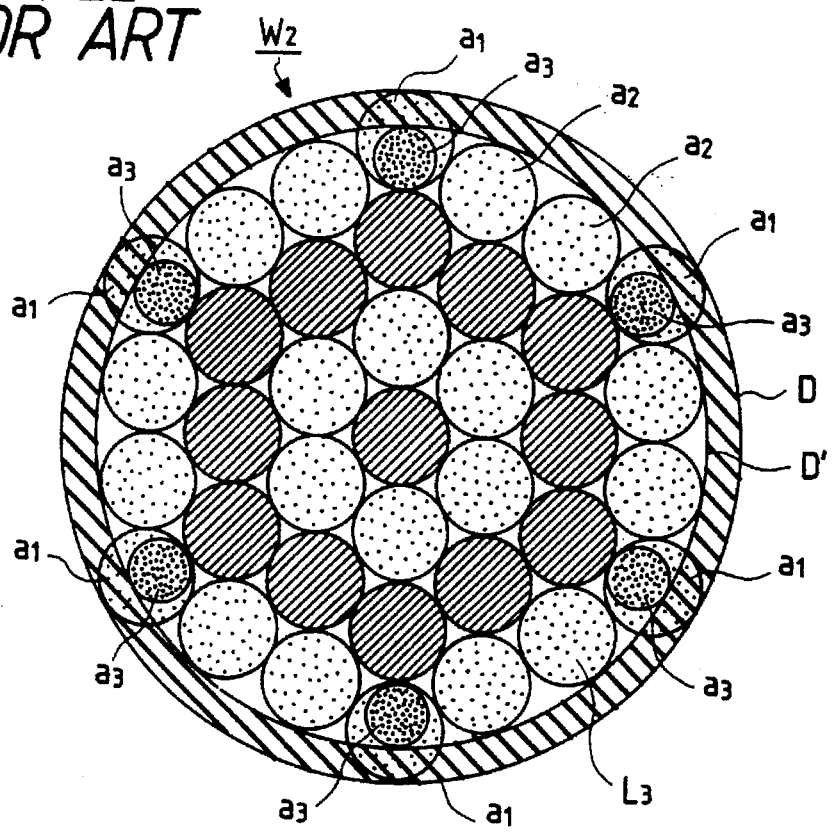
FIG. 22 PRIOR ART
FIG. 22 is a cross-sectional view of a 37-core base stranded wire shown for explaining a conventional production method.
Figure 23:
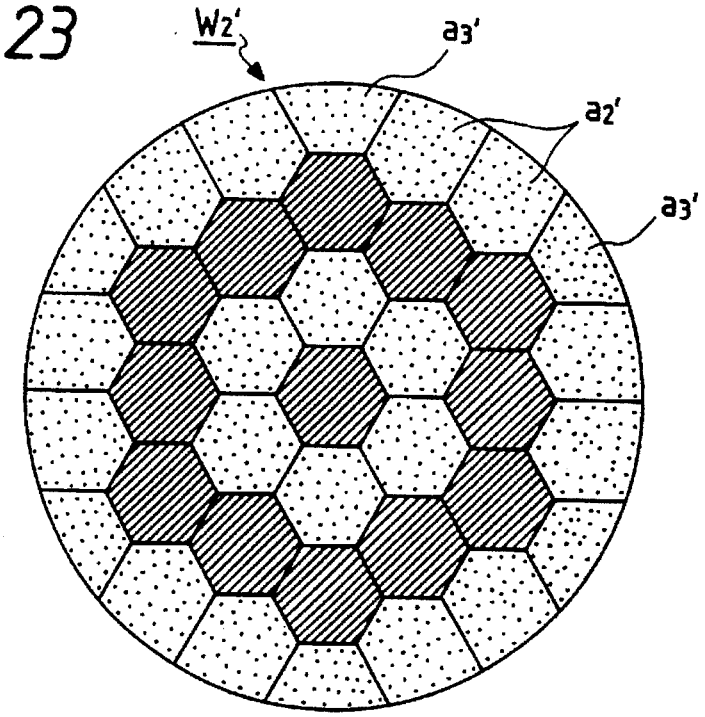
FIG. 23 is a cross-sectional view of a 37-core multi-layer compressed stranded conductor produced from the twisted wire of FIG. 22.

Therefore, as shown in FIG. 22, those wire elements $a_1$ of an outermost or third layer $L_3$ of a multi-layer twisted wire $W_2$ which constitute apexes of a regular hexagon are replaced by wire elements $a_3$ of a smaller diameter so that all of the wire elements $a_2$ and $a_3$ can be in contact with a contacting circle D' of a die hole. By doing so, there is obtained a compressed stranded conductor $W_2'$ having the compressed wire elements $a_2$ and $a_3$ at the outermost layer (see FIG. 23), and thus a uniform compression is achieved.

However, with this method in which those wire elements $a_1$ constituting the apexes of the hexagonal outermost layer are replaced by the wire elements $a_3$ of a smaller diameter, and then the compression is effected, the burden of management on the operator increases since only 6 wire elements $a_3$ of the different diameter are used at the manufacturing site where a total of 37 wire elements are handled. And besides, the producing apparatus must ensure that the wire elements $a_3$ of a smaller diameter never fail to be disposed at the apexes of the hexagon. Furthermore, when the smaller diameter of the wire elements $a_3$ is so determined that all of the wire elements of the outermost layer $L_3$ can be in contact with the common circle D', an unnecessary space is formed between the wire element $a_3$ and the adjacent wire elements a, and as a result the wire elements are displaced during the compression processing, which has often caused an unsatisfactory compression. Moreover, for preparing the wire elements $a_3$ of the different diameter, another production step or another producing apparatus must be prepared, which results in a problem that the production cost increases. Actually, with respect to the type of twisted wire having layers twisted alternately in opposite directions, a compressed twisted wire having a complete dense construction as in FIG. 23 can not be obtained.

In contrast, the inventors of the present invention have found that the multi-layer compressed twisted wire having a space factor of almost 100% can be obtained by imparting compression and twisting to the base stranded wire having the constituent wire elements twisted in the same direction at the same pitch as described above for the first embodiment, instead of using the multi-layer alternately twisted wire of the above conventional construction. In this case, a multi-layer twisted wire (19-core) having up to a second layer $L_2$ as shown in FIG. 5 can be compressed easily, but in multi-layer twisted wires (37-core, 61-core) having more wire elements, the balance between the twisted wire elements is lost during the compression operation to cause so-called "laugh" (the condition in which the twisted wire can not be twisted satisfactorily), and in the worst case the wire elements are severed. Thus, there has been encountered a disadvantage that the stability of the compression processing can not last for a long period of time.

Upon reviewing the cause of this, in the case of a 19-core multi-layer twisted wire as shown in FIG. 5, the number of wire elements disposed on one side of a hexagon p' constituting an outermost layer $L_2$ is three as at $a_1$, $a_2$ and $a_1$, and two $a_1$ and $a_1$ of these wire elements are disposed respectively at the apexes of the hexagon p', and therefore there is only one wire element $a_2$ which is not in contact with a contacting circle D at the outermost layer. On the other hand, in the case of a 37-core wire as shown in FIG. 2, the number of wire elements disposed on one side of a hexagon p' at an outermost layer is four, and two $a_2$ and $a_2$ of these wire elements are not in contact with a contacting circle D. Thus, the number of those wire elements not in contact with the contacting circle is larger, and therefore it is thought that the wire elements are liable to be displaced during the processing, thus causing the above disadvantage. Namely, when the number of those wire elements which are not in contact with the contacting circle D and are disposed on one side of the outermost layer in adjoining relation to each other is two or more, the compression processing becomes unstable. Therefore, in the case of a 61-core wire, the number of the non-contacted wire elements further increases, and therefore the instability of the compression processing further increases.

The inventors of the present invention have found that during the compression of the multi-layer concentric twisted wire in the above-mentioned manner, by reducing the number of those wire elements of the outermost layer, which are not in contact with the contacting circle, to a minimum, the stability of the compression processing is obtained, and that by applying a circular compression at a space factor of not less than 99%, the multi-layer concentric compressed stranded conductor having a constant outer diameter is obtained regardless of the cross-sectional shape of the wire elements. A method of satisfying the above requirements without changing the diameter of the wire elements has been extensively studied, and results thereof will now be described in connection with a second embodiment of the present invention.

Figure 7:
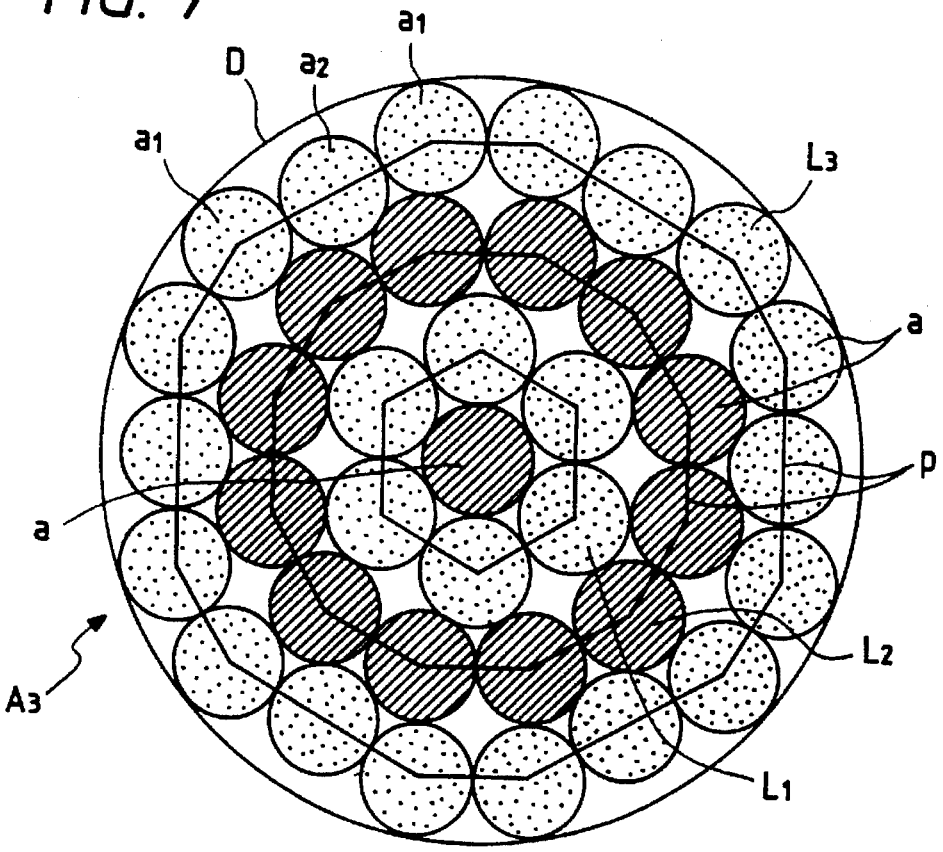
FIG. 7 is a cross-sectional view showing the structure of a 37-core base stranded wire of the present invention to be compressed.
Figure 8:
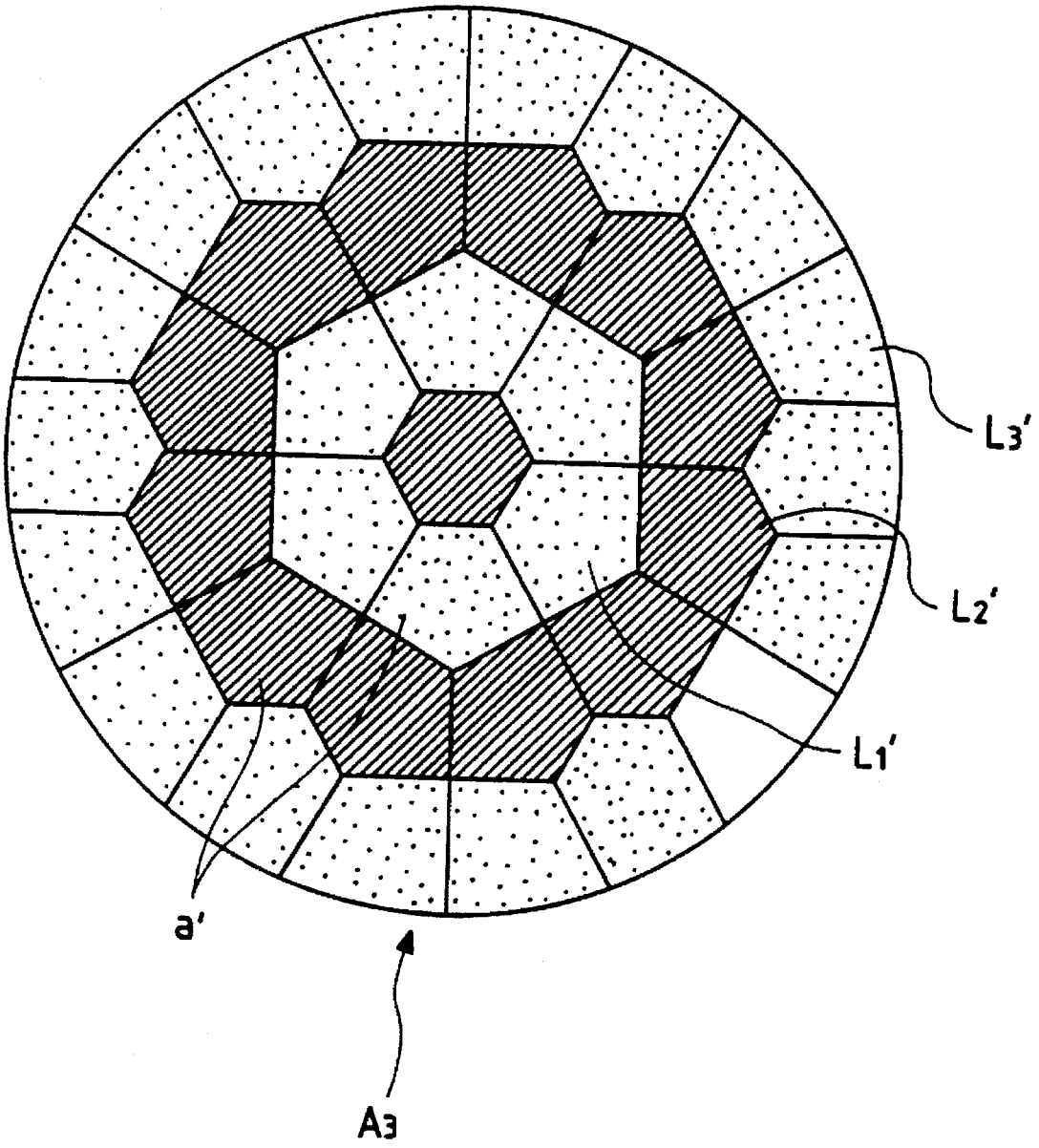

The second embodiment of the present invention will now be described. As shown in FIG. 7, a base stranded wire $A_3$, having layers $L_1$, $L_2$ and $L_3$ of wire elements a of the same diameter twisted concentrically in the same direction at the same pitch (shown in FIG. 1) is compressed by the twisted wire producing apparatus B (shown in FIG. 3) in the same manner as described above for the first embodiment, thereby producing a multi-layer compressed concentric stranded conductor $A_3'$ shown in FIG. 8.

In the base stranded wire $A_3$, a total of 37 wire elements a, that is, the central wire element a, the first layer $L_1$ of 6 wire elements, the second layer $L_2$ of 12 wire elements and the third layer $L_3$ of 18 wire elements, are arranged concentrically except for the central wire element a, and these wire elements are arranged in such a manner that the second and third layers $L_2$ and $L_3$ have a dodecagonal 12 shape as indicated by a connection line P interconnecting the wire elements a of each of the second and third layers $L_2$ and $L_3$, and these wire elements are twisted in the same direction at the same pitch.

Figure 16:
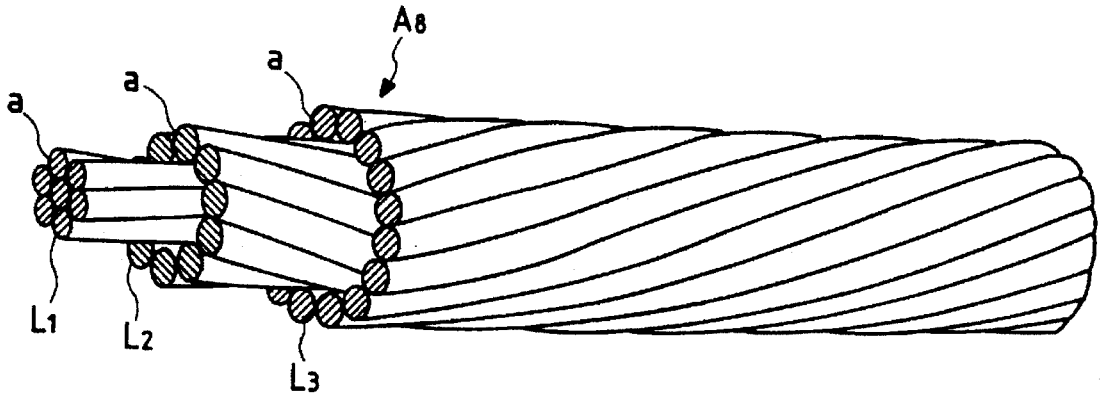
FIG. 16 PRIOR ART
FIG. 16 is a perspective view of a multi-layer twisted wire having alternately oppositely twisted layers.
Figure 17A:
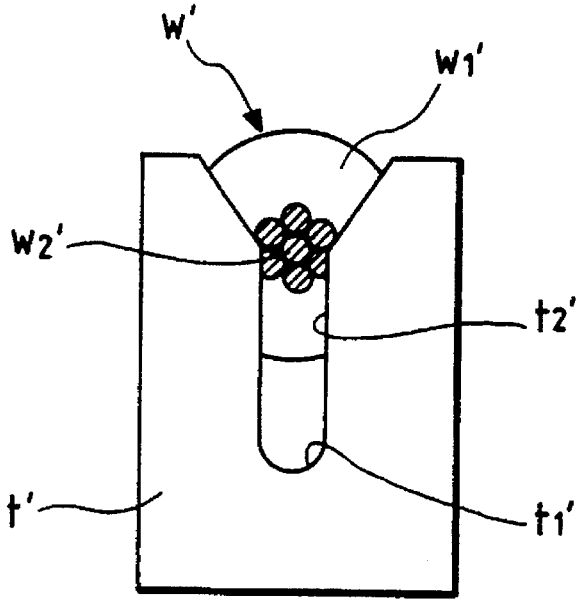
FIG. 17(A) PRIOR ART
FIG. 17(A) is a cross-sectional view showing an initial stage of a press-connecting operation.
Figure 17B:
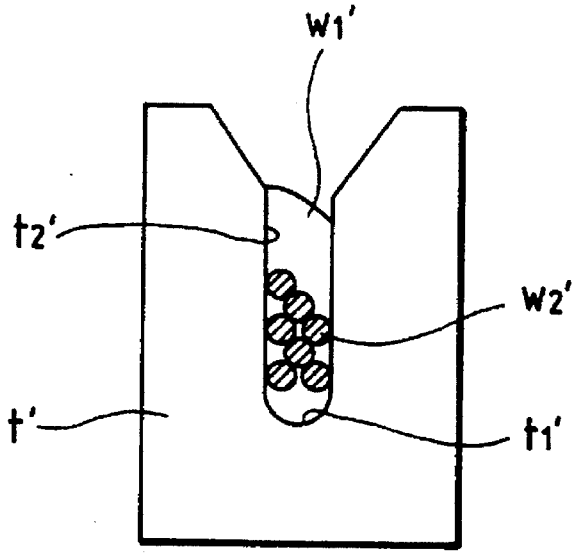
FIG. 17(B) PRIOR ART
FIG. 17(B) is a cross-sectional view showing the press-connected condition.

The multi-layer alternately twisted wire $A_8$ consisting of 37 wire elements is provided as shown in FIG. 16. More specifically, in FIG. 16, the multi-layer alternately twisted wire $A_8$ provides the first layer $L_1$, the second layer $L_2$ and the third layer $L_3$ except for the central wire element a. and all of the wire elements a have the same diameter, and are arranged densely. Therefore, as shown in FIG. 2, with respect to its cross-sectional structure, 6 wire elements a of the first layer $L_1$ are arranged around the central wire element a, and 12 wire elements a of the second layer $L_2$ are arranged on the first layer, and 18 wire elements a of the third layer $L_3$ are further arranged. Each of these wire elements a except for the wire elements of the outermost layer is disposed adjacent to 6 other wire elements, and a line interconnecting the centers of the wire elements a of each of the layers assumes a regular hexagonal shape p'.

The operation will now be described. The multi-layer concentric base stranded wire $A_3$ (see FIG. 7), in which the layers are twisted in the same direction at the same pitch, and the line interconnecting the wire elements a of each of the second and third layers $L_2$ and $L_3$ has a dodecagonal shape, is fed from the base stranded wire supply device $B_1$. Then, this wire first passes through the drawing die 1*a* of the wire twisting and drawing device $B_2$, and is supported by the capstan 4*a*, and then passes through the drawing die 1*b* and then sequentially passes past the capstan 4*b*, the drawing die 1*c* . . . , so that the wire is formed into the compressed twisted wire $A_3'$ of a desired diameter, and is fed to the rotary-type take-up device $B_3$. In the wire twisting and drawing device $B_2$, the propelling force is imparted to the twisted wire by the capstans 4*a*, 4*b*, 4*c* . . . 4*n*. The capstans 4*a*, 4*b*, 4*c* . . . 4*n* angularly move during the passage of the twisted wire, and therefore twisting is imparted in a direction to make the twisting pitch tight during the drawing. Thus, elongation of the twisting pitch is absorbed to such an extent as not to cause so-called "laugh" before the twisted wire passes through the subsequent drawing die.

Thus, the initially-supplied 37-core multi-layer concentric base stranded wire $A_3$, in which the layers are twisted in the same direction at the same pitch, and the line interconnecting the wire elements a of each of the second and third layers $L_2$ and $L_3$ has a dodecagonal shape, is gradually compressed and processed into a space factor of not less than 99%. In this case, since there is used the multi-layer concentric twisted wire in which the line interconnecting the wire elements a of the outermost, layer has a dodecagonal shape, two wire elements $a_1$ disposed respectively at the apexes firmly hold one non-contacted wire element $a_2$ therebetween. Therefore, the compressive force was transmitted satisfactorily, so that the stability of the processing was obtained.

As a result, there was stably obtained the 37-core multi-layer compressed concentric stranded conductor $A_3'$ (shown in FIG. 8) characterized in that the wire elements a' of the first and second layers $L_1'$ and $L_2'$ except for the central wire element and the outermost layer $L_3'$ have a pentagonal cross-sectional shape.

Figure 9:
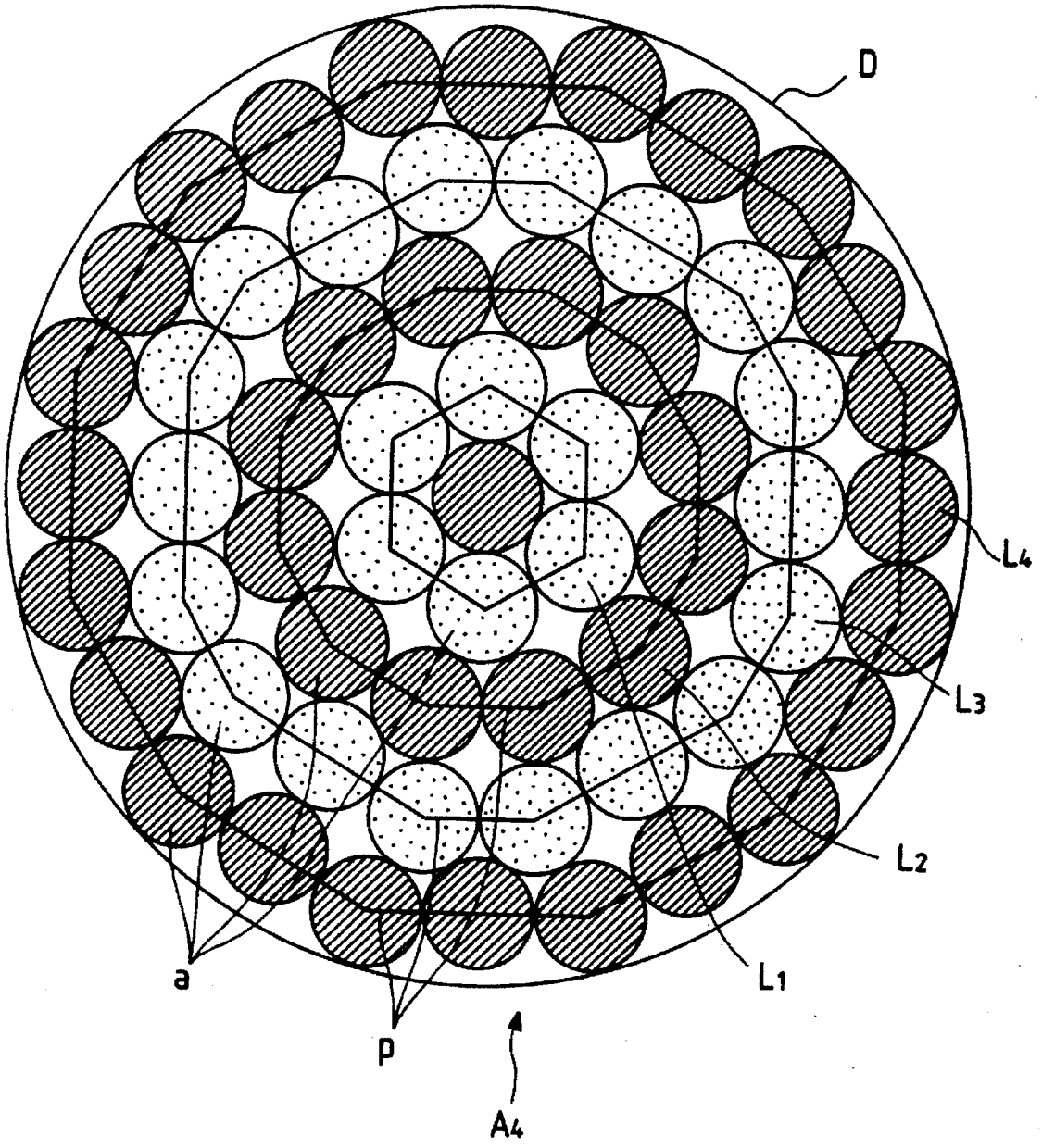
FIG. 9 is a cross-sectional view showing the structure of a 61-core base stranded wire of the present invention to be compressed.
Figure 10:
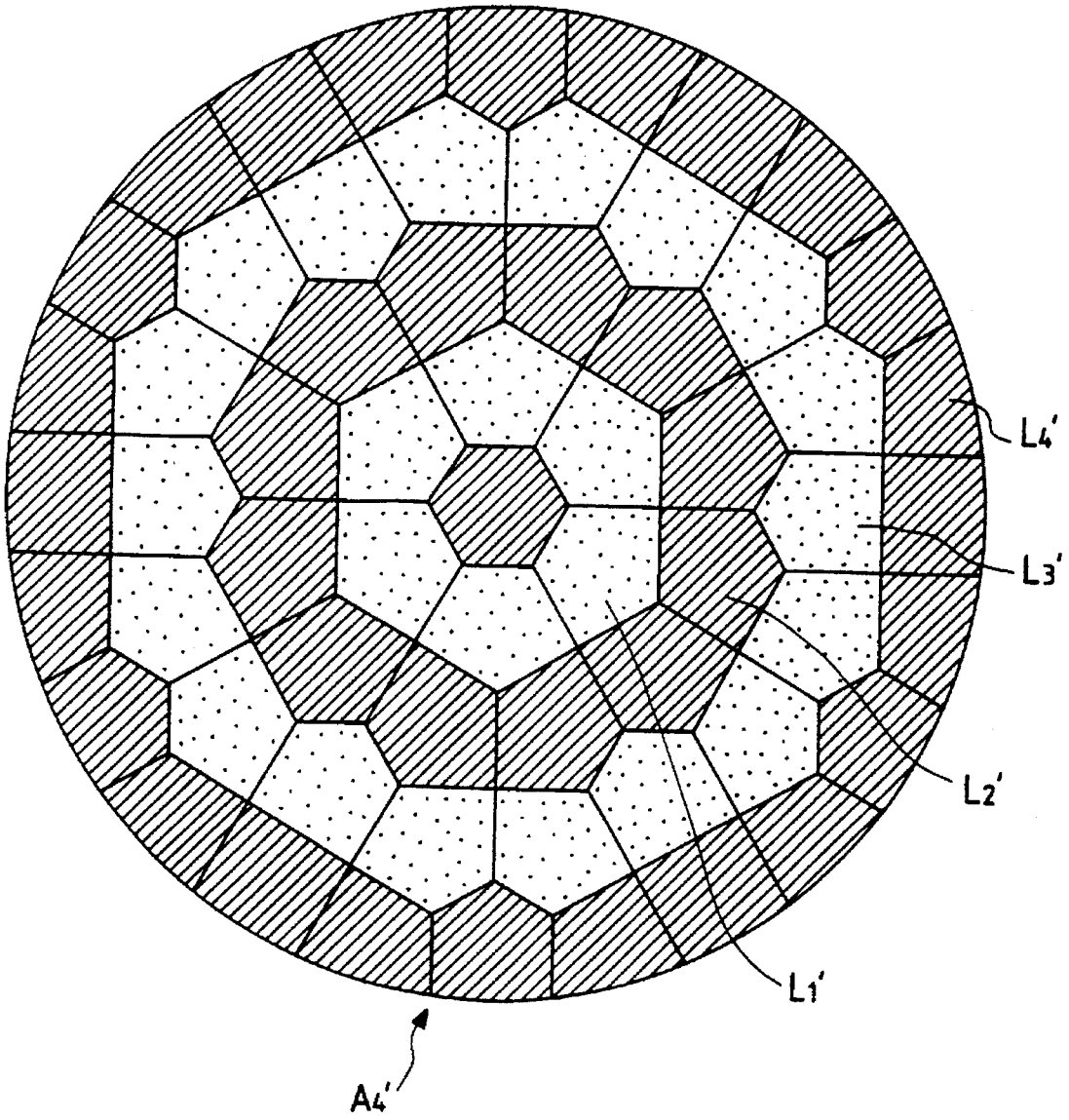
FIG. 10 is a cross-sectional view of a 61-core multi-layer compressed concentric stranded conductor produced by compressing the twisted wire of FIG. 9.

When similarly processing a multi-layer concentric base stranded wire $A_4$ (shown in FIG. 9) in which a total of 61 wire elements a of the same diameter, that is, the central wire element, a first layer $L_1$ of 6 wire elements, a second layer $L_2$ of 12 wire elements, a third layer $L_3$ of 18 wire elements and a fourth layer $L_4$ of 24 wire elements, are arranged concentrically except for the central wire element in such a manner that the second to fourth layers $L_2$ to $L_4$ have a dodecagonal shape as indicated by a connection line P interconnecting the wire elements a of each of the second to fourth layers, and that these wire elements are twisted in the same direction at the same pitch, there was stably obtained a 61-core multi-layer compressed concentric stranded conductor $A_4'$ (shown in FIG. 10) characterized in that the wire elements a' of the first, second and third layers $L_1'$, $L_2'$ and $L_3'$ except for the central wire element and the outermost layer $L_4'$ have a pentagonal cross-sectional shape.

Figure 11:
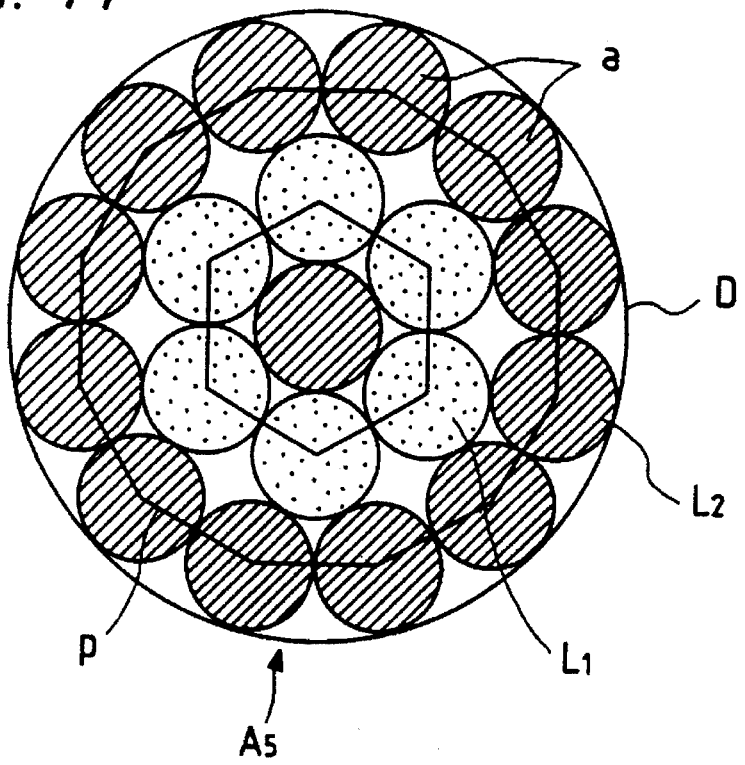
FIG. 11 is a cross-sectional view showing the structure of a 19-core base stranded wire of the present invention to be compressed.
Figure 12:
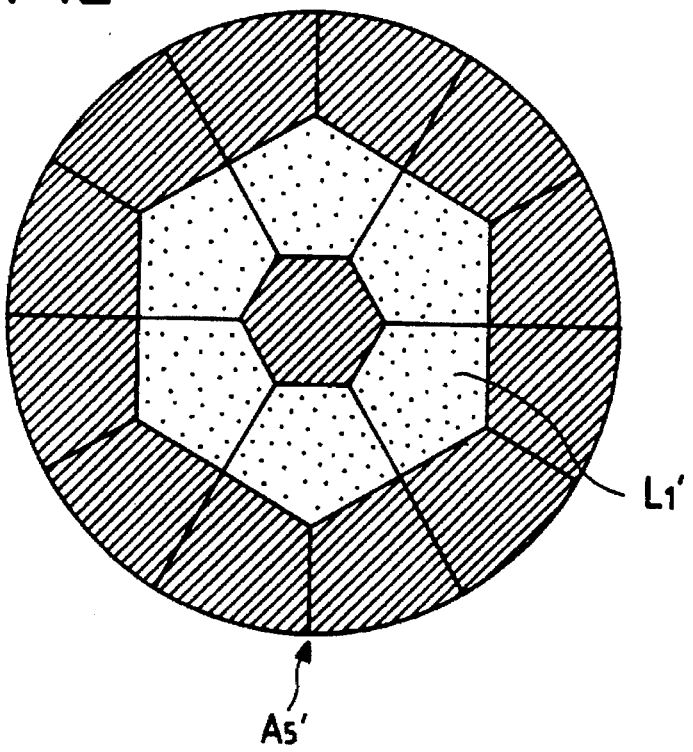
FIG. 12 is a cross-sectional view of a 19-core multi-layer compressed concentric stranded conductor produced by compressing the twisted wire of FIG. 11.
Figure 13:
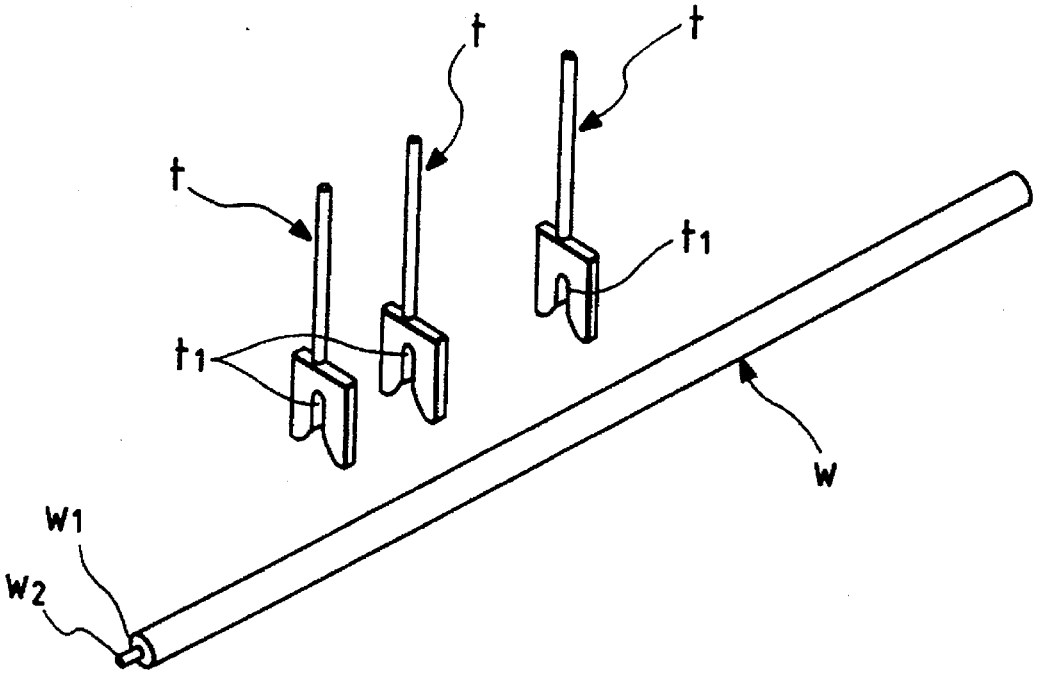
FIG. 13 PRIOR ART
FIG. 13 is a perspective view showing a press-connection.

Further, with the production method of the present invention, when similarly processing a multi-layer concentric base stranded wire $A_5$ (shown in FIG. 11) in which a total of 19 wire elements of the same diameter, that is, the central wire element, a first layer $L_1$ of 6 wire elements and a second layer $L_2$ of 12 wire elements, are arranged concentrically except for the central wire element in such a manner that the second layer $L_2$ has a dodecagonal shape as indicated by a connection line P interconnecting the wire elements of the second layer, and that these wire elements are twisted in the same direction at the same pitch, there was quite stably obtained a 19-core multi-layer compressed concentric stranded conductor $A_4'$ (shown in FIG. 12) characterized in that the wire elements of the first layer $L_1'$ has a pentagonal cross-sectional shape, since all of the wire element of the outermost layer are disposed in contact with a die hole.

In the multi-layer concentric compressed twisted wires of the present invention and the production method of the present invention, the wire elements of the same diameter are twisted together in such a manner that the line interconnecting the centers of the wire elements of each of those layers including the second layer and any other layer disposed outside of the second layer has a dodecagonal shape, and then are compressed into a circular cross-section. Therefore, during the compression operation, the ratio of the wire element of the outermost layer not in contact with the die hole to the wire elements in contact with the die hole is not more than 1:2, and therefore the compression processing can be effected stably. As a result, there is produced the multi-layer concentric compressed twisted wire in which the wire elements, except for the central wire element and those of the outermost layer, has a pentagonal cross-sectional shape.

In the multi-layer concentric compressed twisted wires of the present invention and the production method of the present invention, the number of the wire elements is limited to up to 61. If the number is more than that, the ratio of the wire elements not in contact with the die hole to the wire elements in contact with the die hole is more than 1:2, so that the instability during the compression operation increases. Since the wire elements of the same diameter are used, the number of the wire elements of the Nth layer except for the central wire element is 6N, and since the plurality of layers of the wire elements are twisted concentrically in the same direction at the same pitch, the conductor can be cross-sectionally circularly compressed into a space factor of not less than 99%. Each of the wire elements, except for the central wire element and those of the outermost layer, is disposed adjacent to 5 other wire elements, and therefore is formed into a pentagonal cross-sectional shape by the compression. With this construction of the compressed twisted wire, an excellent processability can be obtained during the compression operation, and besides the completely compressed twisted wire has a sufficient flexibility, and the wire elements are combined together, and therefore the ability of maintaining the cross-sectional shape is quite high.

The wire for a press-connecting terminal of an electrical equipment and a transport machine, provided according to the first embodiment of the present invention, has a high flexibility, and can be easily installed, and therefore the efficiency of mounting a harness wire can be enhanced. And besides, since the ability of maintaining the cross-sectional shape is quite high, the reliability of the connection portion at the time of press-connection is high, and any disadvantage is less liable to occur.

Apparently, the wire has a substantially completely circular cross-section, and therefore there is obtained the conductor having the same outer diameter and the same cross-sectional area as those of a single wire, and the wire can be of a small-diameter design.

By using the production method of the present invention, the completely-compressed, multi-layer conductor can be obtained by one processing step, and therefore the manufacturing cost can be kept to a level substantially equal to that of the conventional incompletely-compressed conductor.

The wire of the present invention for an electrical equipment and a transport machine is concentrically twisted in the same direction at the same pitch. Otherwise, the position of the wire elements of the twisted wire with respect to one another would not always be constant, and a stable dense structure would not be obtained.

If the space factor is less than the above specified value, the density is lowered, and the circular cross-sectional shape is liable to get out of shape during the press-connecting, thus causing a disadvantage. The reason why the space factor is not less than 99% is to prevent this and also to achieve a satisfactory small-diameter design.

In the multi-layer compressed concentric stranded conductor of the second embodiment of the present invention and the method of producing the same, the condition of contact of the wire elements with the die hole is stable, and the compressive force can be stably applied also to the non-contacted wire elements. As a result, a quite stable compression processing can be effected, and therefore an accident such as the cutting of the wire during the manufacture can be prevented, thus markedly enhancing the efficiency of the operation.

Furthermore, in the method of producing the multi-layer compressed concentric stranded conductor, provided in accordance with the present invention, the processing can be stably carried out without using wire elements of a different diameter during the manufacturing process, and therefore the operator's job for the management at the manufacturing site will not be increased. Furthermore, any facility or equipment for producing wire elements of another diameter is not required, and therefore the manufacturing cost will not be increased.

What is claimed is:

1. A method of producing a conductive wire for a press-connecting terminal, comprising the steps of:

(a) reducing the diameter of a base stranded wire, including a plurality of wire elements, by passing said base stranded wire through an orifice smaller in cross-sectional area than said base stranded wire; and (b) imparting twisting to said base stranded wire so that said wire elements are concentrically twisted in the same direction at a same pitch, wherein not more than 61 of said wire elements of the same diameter are twisted together so that said wire elements have a dodecagonal shape in a line interconnecting centers of said wire elements of each layers including a second layer counting from a central wire element and including other layers outside said second layer, in which said wire elements comprise N layers except for said central wire element, and in which said wire elements of an Nth layer comprise 6N elements.

2. The method of claim 1, further comprising the step of compressing said base stranded wire twisted by said step (b), into a circular cross-sectional shape.

3. An apparatus for producing a conductive wire for a press-connecting terminal, comprising:

a diameter reducing device for reducing the diameter of a base stranded wire, including a plurality of wire elements, by passing said base stranded wire through an orifice smaller in cross-sectional area than said base stranded wire; and a twisting device for imparting twisting to said base stranded wire so that said wire elements are concentrically twisted in the same direction at a same pitch, wherein not more than 61 of said wire elements of the same diameter are twisted together so that said wire elements have a dodecagonal shape in a line interconnecting centers of said wire elements of each layers including a second layer counting from a central wire element and including other layers outside said second layer, in which said wire elements comprise N layers except for said central wire element, and in which said wire elements of an Nth layer comprise 6N elements.

* * * * *